US009627824B2

(12) United States Patent
Giangrande et al.

(10) Patent No.: US 9,627,824 B2
(45) Date of Patent: Apr. 18, 2017

(54) ELECTRICAL CONNECTOR AND RETAINING DEVICE

(71) Applicant: Johnson Electric S.A., Murten (CH)

(72) Inventors: Giovanni Giangrande, Asti (IT); Roberto Almondo, Monta D'Alba (IT)

(73) Assignee: JOHNSON ELECTRIC S.A., Murten (CH)

( * ) Notice: Subject to any disclaimer, the term of this patent is extended or adjusted under 35 U.S.C. 154(b) by 14 days.

(21) Appl. No.: 14/604,319

(22) Filed: Jan. 23, 2015

(65) Prior Publication Data

US 2015/0207276 A1 Jul. 23, 2015

(30) Foreign Application Priority Data

Jan. 23, 2014 (IT) ..... TO2014U0013

(51) Int. Cl.
*H01R 13/66* (2006.01)
*H01R 13/73* (2006.01)

(52) U.S. Cl.
CPC ..... *H01R 13/73* (2013.01); *H01R 2201/26* (2013.01)

(58) Field of Classification Search
CPC ..... H01R 13/73; H01R 2201/26; H01R 13/74
USPC ..... 439/527, 34, 575; 411/510
See application file for complete search history.

(56) References Cited

U.S. PATENT DOCUMENTS 6,190,197 B1 * 2/2001 Polgar ..... H01R 13/6315 439/527
6,203,364 B1 * 3/2001 Chupak ..... H01R 13/60 439/527
6,358,087 B1 * 3/2002 Haar ..... F01P 5/02 248/222.12
6,431,910 B1 * 8/2002 Chuang ..... F04D 29/601 415/220
6,478,602 B1 * 11/2002 Chapman ..... H01R 13/639 439/373
6,808,411 B2 * 10/2004 Chen ..... F04D 29/601 361/695
7,338,314 B2 * 3/2008 Thai ..... H01R 43/26 248/51
7,500,867 B1 * 3/2009 Doglio ..... H01R 13/5812 248/251
7,867,024 B2 * 1/2011 Fraysse ..... H01R 13/6273 439/575
7,891,926 B2 * 2/2011 Jackson, Jr. ..... F16B 21/084 411/510

(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

An electrical connector has a body, with an input part forming passages for corresponding electrical cables, and a base from which two stems project. The connector is associated with a retaining device including a base plate from which two facing sprung retaining elements extend. A retaining region adapted to receive the input part of the connector is formed between these elements. The retaining elements have retaining formations capable of being spread apart by the input part of the connector when it is inserted into the retaining region, and of retaining the input part in the retaining region thereafter. A pair of openings is formed in the base plate between the sprung elements, into which the stems of the base of the connector are insertable.

7 Claims, 2 Drawing Sheets

(56) References Cited

U.S. PATENT DOCUMENTS

| | | | | |
|---|---|---|---|---|
| 8,167,645 | B2 * | 5/2012 | Gerullis | H01R 4/2433 248/214 |
| 8,221,042 | B2 * | 7/2012 | Vitali | F16B 21/086 411/510 |
| 8,287,307 | B2 * | 10/2012 | Gerullis | H01R 4/2433 248/214 |
| 8,517,678 | B2 * | 8/2013 | Li | G06F 1/20 415/213.1 |
| 8,545,239 | B1 * | 10/2013 | Oyster | H01L 31/05 439/76.1 |
| 8,932,073 | B2 * | 1/2015 | Weickenmeier | H01R 13/6273 439/345 |
| 9,011,106 | B2 * | 4/2015 | Pal | F04B 49/06 417/44.1 |
| 9,188,131 | B2 * | 11/2015 | Speretta | F04D 25/0693 |
| 2013/0088106 | A1 * | 4/2013 | Bitzer | H01R 13/5202 310/71 |
| 2013/0156572 | A1 * | 6/2013 | Murador | F04D 29/646 415/213.1 |
| 2013/0156619 | A1 * | 6/2013 | Speretta | F04D 25/0693 417/423.7 |
| 2013/0210259 | A1 * | 8/2013 | Weickenmeier | H01R 13/6273 439/345 |

* cited by examiner

ELECTRICAL CONNECTOR AND RETAINING DEVICE

CROSS REFERENCE TO RELATED APPLICATIONS

This non-provisional patent application claims priority under 35 U.S.C. §119(a) from Patent Application No. TO 2014 U 000013 filed in Italy on Jan. 23, 2014, the entire contents of which are hereby incorporated by reference.

FIELD OF THE INVENTION

This invention relates to an electrical connector and a corresponding retaining device for an electric cooling fan unit of a heat exchanger, such as a radiator, for a motor vehicle.

BACKGROUND OF THE INVENTION

Electric cooling fans have a connector for connecting wires from the electrical power supply to the fan unit. In a motor vehicle, especially in the engine compartment, the connector in use is subject to high levels of vibration. During assembly, the connector is tied to a structural support after the fan unit is fitted to the vehicle and after the connection is made, resulting in an inefficient connection and assembly method.

SUMMARY OF THE INVENTION

Hence there is a desire for a solution for fixing the connector, in a stable and reliable way, to the supporting structure (known as the "shroud") of an electric fan unit of this type, while preventing, in particular, the rotation of this connector and simplifying the assembly operations on the production line.

Accordingly, in one aspect thereof, the present invention provides an electrical connector and corresponding retaining device, for an electric cooling fan unit of a heat exchanger for a motor vehicle, wherein the connector comprises a substantially rigid body of elongate shape, with an input part forming a pair of adjacent passages for corresponding insulated electrical cables, the body having a base from which a pair of parallel transverse stems project; and wherein the retaining device comprises a base plate from which two facing sprung retaining elements extend, a retaining region adapted to receive the input part of the connector being formed between the retaining elements; the retaining elements being provided with respective retaining formations capable of being spread apart by the input part of the connector when it is inserted into the retaining region, and of retaining the input part of the connector in the retaining region thereafter, and a pair of openings being formed in the base plate between the retaining elements, into which openings the stems of the base of the connector are insertable.

Preferably, the stems and the corresponding openings of the retaining device, have differing diameters.

Preferably, at least one of the stems has lateral formations adapted to allow its easy insertion into the corresponding opening of the base plate, and to impede its extraction.

Preferably, the base plate is made as a one piece monolithic structure with a supporting structure of the electric cooling fan unit.

Preferably, the supporting structure of the electric cooling fan unit is a fan shroud.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
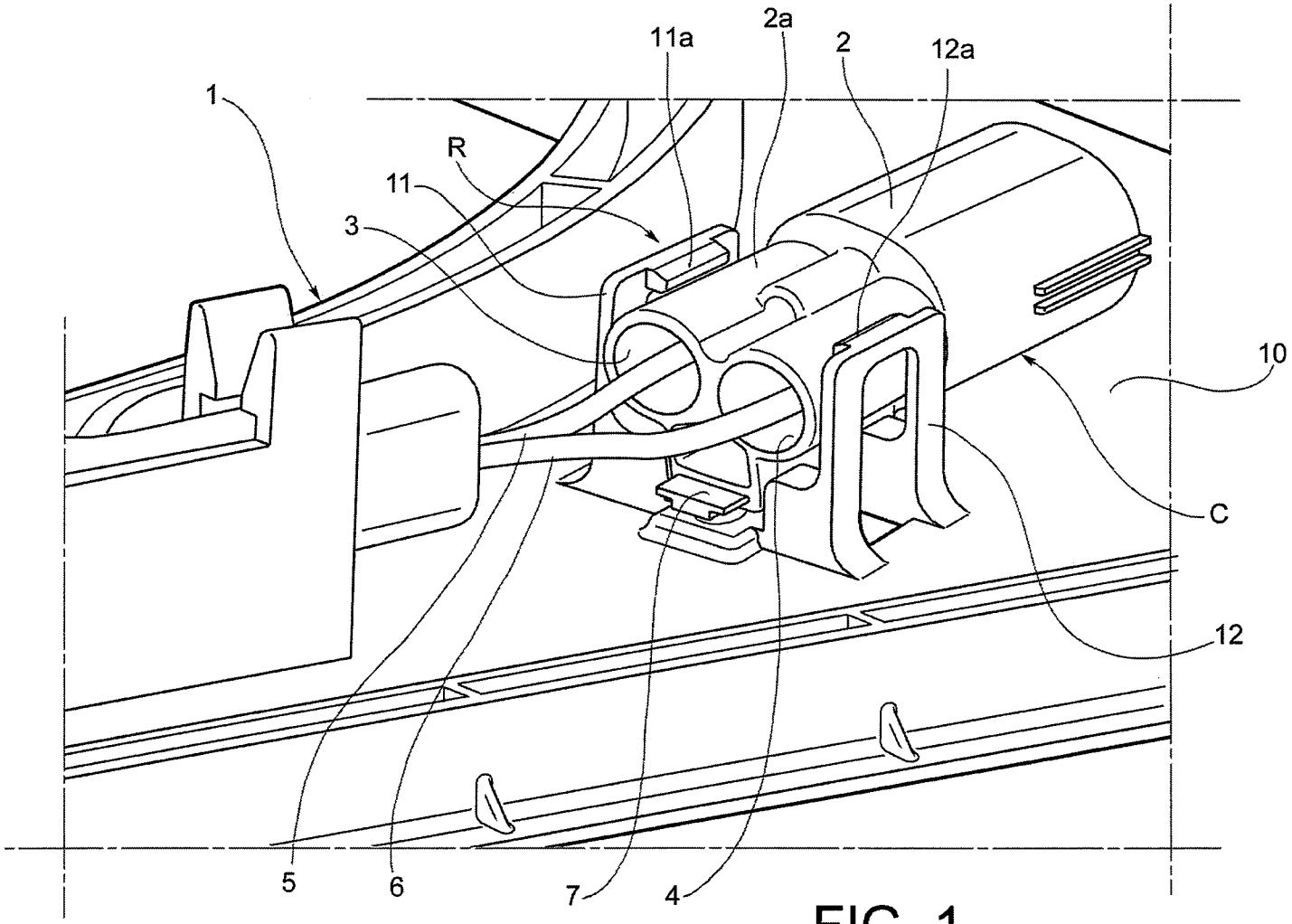
FIG. 1 is a partial, perspective view of a supporting structure of an electric fan unit for a heat exchanger of a motor vehicle, comprising an electrical connector and an associated retaining device according to the present invention.

In FIG. 1, the number 1 indicates the whole of the supporting structure or shroud of an electric cooling fan unit for a heat exchanger, such as a radiator, of a motor vehicle.

In a known way, this electric fan unit 1 comprises an impeller (not shown) which is made to rotate by an electric motor (not shown), of the brushless type for example. This motor is associated with a voltage regulator which, in turn, is connected to the on-board battery of the motor vehicle by means of a connector, such as that indicated as a whole by C in the drawings.

The connector C comprises a substantially rigid body 2, made of molded plastic material for example, having an elongate shape. This body 2 has an input part 2*a* having a cross-section in the shape of a figure 8, forming a pair of adjacent passages 3 and 4 for corresponding insulated electrical conductors 5 and 6 (FIG. 1).

The connector C also has a base 7 (see FIG. 2 in particular) from the underside of which two parallel transverse stems 8 and 9 protrude.

In the embodiment illustrated by way of example, the stems 8 and 9 are aligned with one another in the longitudinal direction of the body 2 of the connector C.

Advantageously, said stems 8 and 9 have different respective diameters. Additionally, one of the two stems, for example the stem indicated by 9 in FIG. 2, has a serrated profile adapted to facilitate its introduction into an opening of corresponding dimensions and to impede its subsequent extraction.

The connector C is associated with a retaining device indicated as a whole by R in the drawings.

This retaining device R essentially comprises a base plate 10, which in the illustrated embodiment is a corner portion of the supporting structure or shroud 1.

Figure 2:
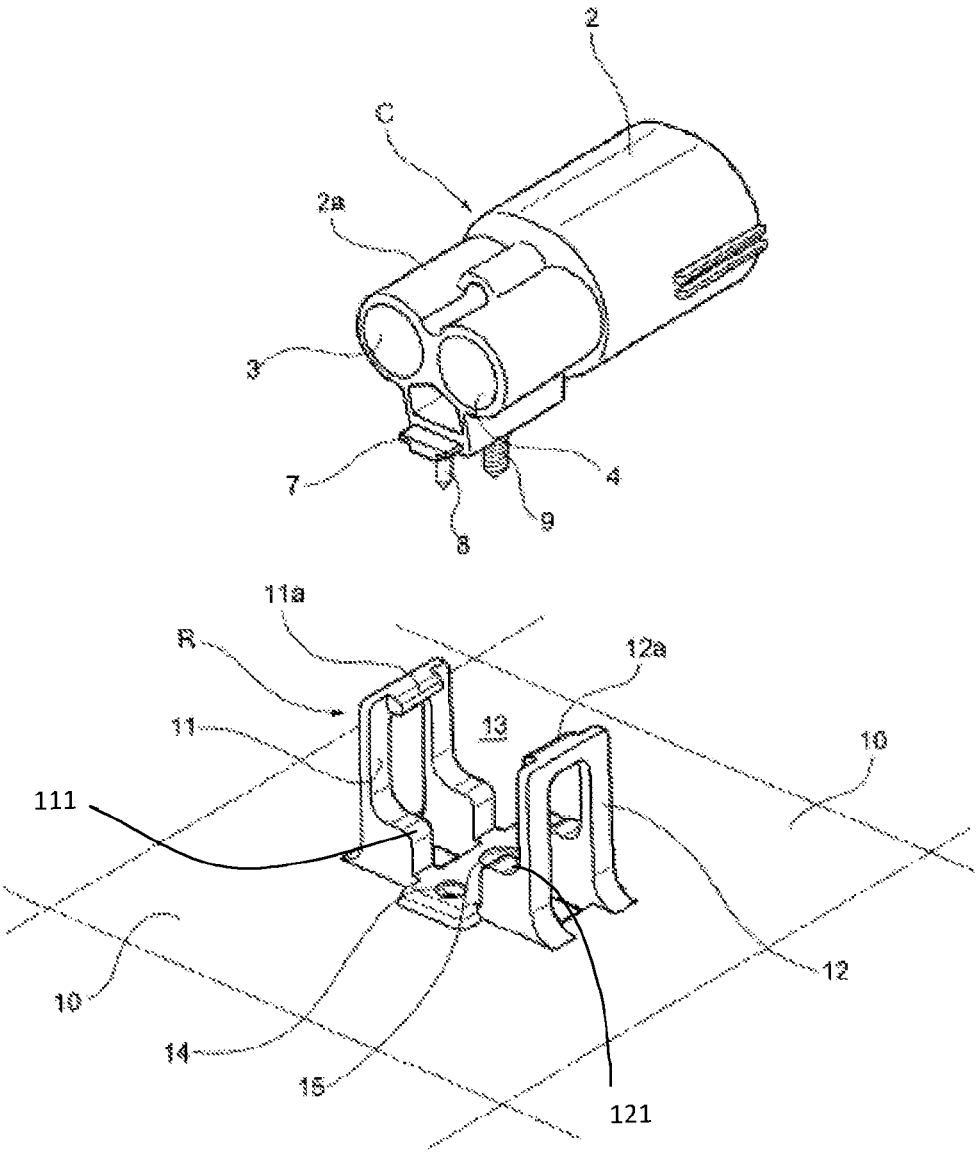
FIG. 2 is a partially exploded, partial, perspective view showing the connector and the associated retaining device.

From the plate 10 there extend two sprung retaining elements 11 and 12, which face one another and are symmetrical, a retaining region indicated by 13 in FIG. 2 being formed between these elements and being intended to receive the input part 2*a* of the body 2 of the connector C he input part is supported by the two sprung retaining elements without contacting the base plate. The two sprung retaining element 11 and 12 respectively defines a step portions 111 and 121, the input part is supported on top surfaces of two step portions 111 and 121 without contacting the base plate 10. A length of the sprung retaining element 11 is equal to a length of the passage 3.

These sprung elements 11 and 12 have an overall configuration which is essentially in the shape of an inverted U, and each element has a respective projecting retaining formation 11*a*, 12*a* at its distal end, these formations facing one another.

The retaining formations 11*a*, 12*a* can be spread apart, because of the flexibility of the sprung elements 11 and 12, when the input part 2*a* of the connector C is inserted, with an interference fit, into the retaining region 13.

In the condition in which the connector C is inserted in the retaining device R, visible in FIG. 1, the retaining formations 11*a* and 12*a* firmly grip the portion 2*a* of the body 2 of the connector C.

When the connector C is coupled to the retaining device R, its stems 8 and 9 engage in corresponding openings 14 and 15 (FIG. 2) formed in the base plate 10 between the proximal ends of the sprung elements 11 and 12.

The distance between the diameters of the stems 8 and 9, and correspondingly between the diameters of the openings 14 and 15, is such that the connector C can be coupled to the retaining device R solely in a predetermined orientation, namely the orientation visible in FIG. 1.

As mentioned above, one of the two stems, for example the stem 9, may be provided with lateral corrugations adapted to allow easy insertion of the stem into the corresponding opening of the base plate 10 and to make its extraction more difficult.

The sprung elements 11 and 12 are conveniently made integrally, that is to say in one piece, with the supporting structure 1, which is typically made of molded plastic material.

The solution described above enables the connector C to be retained stably and reliably in the working position shown in FIG. 1.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. An electrical connector and corresponding retaining device, for an electric cooling fan unit of a heat exchanger for a motor vehicle, wherein the connector comprises a substantially rigid body of elongate shape, with an input part forming a pair of adjacent passages for corresponding insulated electrical cables, said body having a base from which a pair of parallel transverse stems project; and wherein the retaining device comprises a base plate from which two facing sprung retaining elements extend, a retaining region adapted to receive said input part of the connector being formed between the retaining elements; said retaining elements being provided with respective retaining formations formed on distal ends thereof and capable of being spread apart by said input part of the connector when it is inserted into the retaining region, and of retaining said input part of the connector in said retaining region thereafter, and a pair of openings being formed in said base plate between said retaining elements, into which openings said transverse stems of the base of the connector are insertable; and wherein each sprung retaining element defines a step portion, the input part is supported on top surfaces of two step portions without contacting the base plate.

2. The electrical connector and corresponding retaining device of claim 1, wherein said stems and the corresponding openings of the retaining device, have differing diameters.

3. The electrical connector and corresponding retaining device of claim 1, wherein at least one of said stems has lateral formations adapted to allow its easy insertion into the corresponding opening of the base plate, and to impede its extraction.

4. The electrical connector and corresponding retaining device of claim 1, wherein said base plate is made as a one piece monolithic structure with a supporting structure of the electric cooling fan unit.

5. The electrical connector and corresponding retaining device of claim 4, wherein said supporting structure of the electric cooling fan unit is a fan shroud.

6. An electric cooling fan unit for a heat exchanger of a motor vehicle, incorporating the electrical connector and corresponding retaining device of claim 1.

7. The electrical connector and corresponding retaining device of claim 1, wherein a length of the sprung retaining element is equal to a length of the passage.

* * * * *